US006266856B1

(12) United States Patent
Fehrer et al.

(10) Patent No.: US 6,266,856 B1
(45) Date of Patent: Jul. 31, 2001

(54) FACILITY FOR NEEDLING OF FLEECE

(75) Inventors: Monika Fehrer, Leonding; Ludwig Legl, Buchkirchen, both of (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 09/685,348

(22) Filed: Oct. 10, 2000

(30) Foreign Application Priority Data

Oct. 29, 1999 (AT) ..... 1819/99

(51) Int. Cl.[7] ..... D04H 18/00
(52) U.S. Cl. ..... 28/107; 28/114
(58) Field of Search ..... 28/107, 111, 113, 28/114, 115

(56) References Cited

U.S. PATENT DOCUMENTS 3,535,756 10/1970 Kuts et al. .
3,798,717 * 3/1974 Brochetti ..... 28/107
3,849,845 * 11/1974 Obenaus ..... 28/107
4,884,324 * 12/1989 Stanislaw ..... 28/107
5,732,453 * 3/1998 Dilo et al. ..... 28/114
5,873,152 * 2/1999 Jourde et al. ..... 28/107
6,000,112 * 12/1999 Ollinger et al. ..... 28/107

FOREIGN PATENT DOCUMENTS 2 264 257 11/1973 (DE) .
196 15 697 3/1997 (DE) .
0 892 102 5/1998 (EP) .

* cited by examiner

*Primary Examiner*—Danny Worrell
(74) *Attorney, Agent, or Firm*—Collard & Roe, P.C.

(57) ABSTRACT

The description relates to a facility for needling of fleece with at least one needle board (2) that can be driven to and fro in stitching direction (4) by means of pushing rods (3) borne displaceable in one guide sleeve (10) each, and with an additional drive (11) reciprocating in fleece feed direction (9) and effective on the movably borne guide sleeves (10), which is equipped with two parallel eccentric shafts (12, 13). To achieve simple constructional features it is suggested to bear the guide sleeves (10) via two brackets (16, 17) on the eccentrics (18) of the two equidirectionally driven eccentric shafts (12, 13), and to connect them non-rotatable with at least one of these brackets (16, 17).

2 Claims, 2 Drawing Sheets

FACILITY FOR NEEDLING OF FLEECE

FIELD OF THE INVENTION

The invention relates to a facility for needling of fleece with at least one needle board that can be driven to and fro in stitching direction by means of pushing rods borne displaceable in one guide sleeve each, and with an additional drive reciprocating in fleece feed direction and effective at the movably borne guide sleeves, which is equipped with two parallel eccentric shafts.

DESCRIPTION OF THE PRIOR ART

To extend the feed of fleece, it is known (DE 196 15 697 A1), to provide an additional needle board drive reciprocating in fleece feed direction so that the feed of fleece is extended by the motion component of the needle board in fleece feed direction. Just like the main drive effective in needle stitching direction, this additional drive for the needle board is an eccentric drive, the con-rods of which are articulated at the needle bar. By arranging two parallel eccentric shafts a parallel motion for the needle bar is achieved, as the con-rods constitute the pitmans of an articulated parallelogramm. For adjustment of the stroke the con-rods may be borne on the eccentric shafts via an adjustment eccentric to change the eccentricity of the eccentric shafts. If a parallel motion of the needle bar is abandoned (EP 0 892 102 A2), the con-rods of the two eccentric shafts can be interconnected via a coupler, upon which the needle bar is effective. In case of such an embodiment of the eccentric drive a stroke adjustment via adjustment of the mutual phase position of the two eccentric shafts becomes possible.

To prevent the con-rods of the eccentric drive for the additional reciprocating motion of the needle board in fleece feed direction from joining into the motion of the board in stitching direction, it has already been suggested to bear the pushing rods carrying the needle bar displaceable in guide sleeves, which are pivoted around an axis parallel to the eccentric shafts, so that the eccentric drive for the reciprocating needle board drive in fleece feed direction is not effective at the needle bar or the pushing rods but at the guide sleeves. However, these pivoted guide sleeves do not permit an extensive parallel motion of the needle board, in particular when the length of the guide sleeves shall be kept low.

SUMMARY OF THE INVENTION

It is therefore the objective of the invention to design a facility for needling of fleece of the above mentioned kind in such a way that an extensive parallel motion for the needle board becomes possible at a comparatively low expenditure of construction.

The objective of the invention is achieved by the feature that the guide sleeves are borne on the eccentrics of the equidirectionally driven eccentric shafts via two brackets, and are connected non-rotatable with at least one of these brackets.

By bearing the guide sleeves on the eccentrics of the two eccentric shafts a separate bearing of the guide sleeves is no longer necessary, whereby the construction is considerably simplified. The brackets connected non-rotatable with the guide sleeves permit, for the guide sleeves, only a rotation around the eccentric accommodating these brackets, so that, for definition of the stewing position of the guide sleeves, the latter need only be supported at the parallel eccentric shaft via the other of the brackets arranged in pairs. In the simplest of cases this is also achieved via a bracket connected non-rotatable with the guide sleeves. The pairs of brackets that require an equidirectional rotation of the eccentric shafts, then constitute a parallel motion for the guide sleeves, thus creating favorable guiding conditions for the additional drive of the needle board in fleece feed direction. To balance the unbalance moments as a consequence of the eccentric shafts rotating in same direction, an appropriate balancer shaft may be provided.

In order not to have to adjust the stroke of the eccentric drive for the additional needle board drive in fleece feed direction via a changed eccentricity of the eccentrics, the guide sleeves may be articulated to one of the brackets arranged in pairs, with the drive reciprocating in fleece feed direction being equipped with a device for adjusting the mutual phase position of the two eccentric shafts. Although the guide sleeves are subjected additionally to a rotary oscillation upon a change of the phase position of the two eccentric shafts, the deviation from the center position remains limited, so that guiding conditions are achieved that can largely be compared to those of a parallel motion, in particular in terms of the stitching conditions of the needles into the fleece.

BRIEF DESCRIPTION OF THE DRAWING

The drawing depicts an example of the subject matter of the invention.

DESCRIPTION OF THE PREFERRED EMBODIMENT

Figure 1:
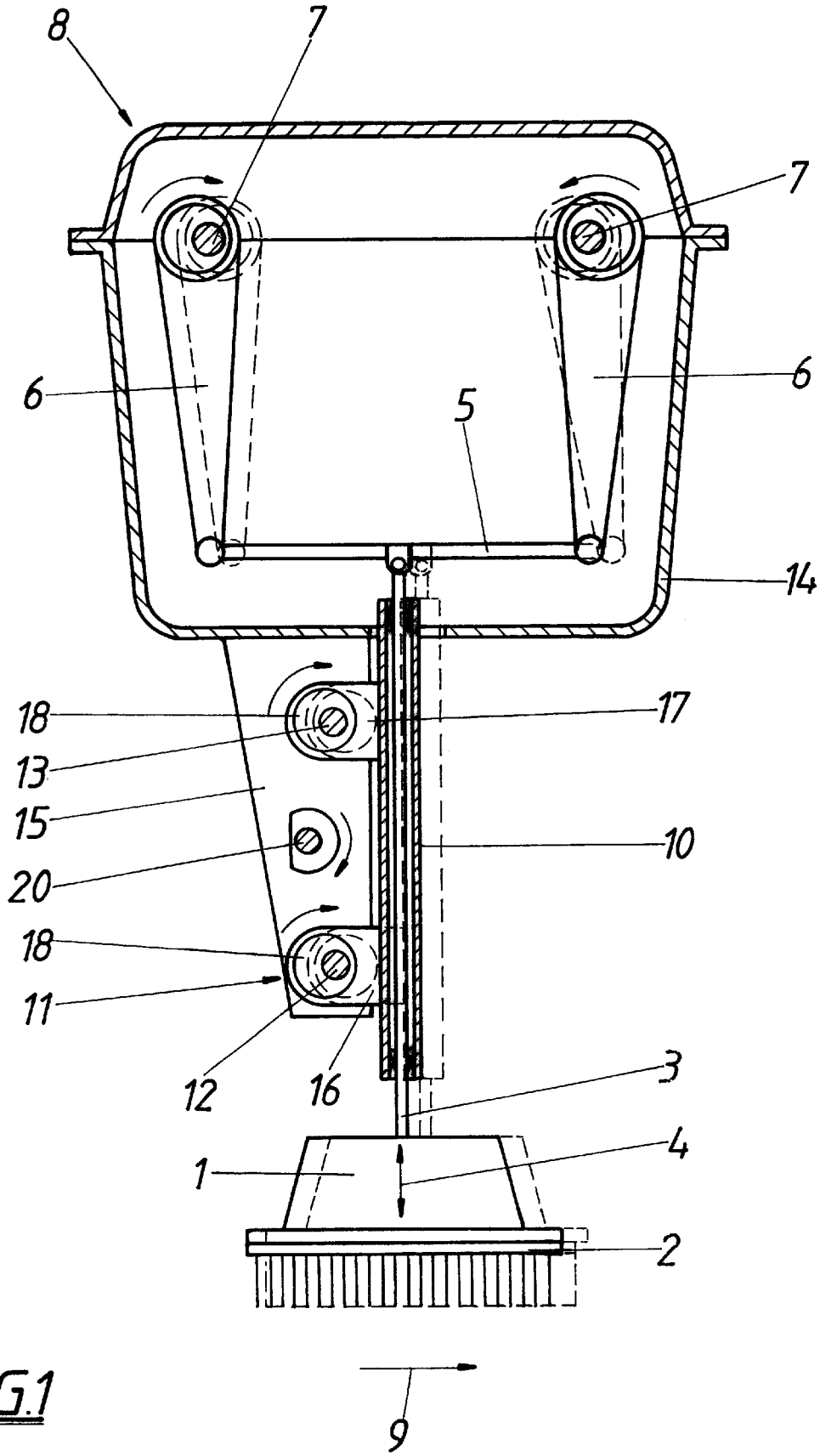
FIG. 1 shows an additional drive for the needle board reciprocating in fleece feed direction of a facility for needling of fleece according to the invention in a schematic section vertical to the eccentric shafts.

According to the depicted examples of embodiment the needle board 2 held in a needle bar 1 is driven to and fro via pushing rods 3 in stitching direction 4. To this end the pushing rods 3 are articulated to a coupler 5 connecting the con-rods 6, arranged in pairs, of two eccentric shafts 7, rotating in opposite direction, of a main drive 8. To be able to additionally drive the needle board 2 to and fro in fleece feed direction 9, the pushing rods 3 are borne axially displaceable in guide sleeves 10, which are connected to a drive 11 reciprocating in fleece feed direction 9. This additional drive 11 is equipped with two equidirectionally rotating eccentric shafts 12 and 13, which are borne in a rest 15 that is rigidly connected with the enclosure 14 of the main drive 8. The arrangement is chosen such that the guide sleeves 10 are supported on the eccentrics 18 of the eccentric shafts 12, 13 via two brackets each, 16 and 17. While the two brackets 16 and 17 of the example of embodiment according to FIG. 1 are connected non-rotatable with the guide sleeves 10, there is, according to the embodiment of FIG. 2, a non-rotatable connection with the guide sleeves 10 only in the area of the bracket 16. The other bracket 17 of the brackets 16 and 17 arranged in pairs is articulated to the pertinent guide sleeve 10 via an articulation axle 19.

Due to the non-rotatable connection between the brackets 16 and 17 on the one hand, and the guide sleeves 10 on the other hand, a parallel motion for the guide sleeves 10 is achieved according to FIG. 1, that is along a circular path determined by the eccentric shafts 12 and 13, of which only the motion component vertical to the guide sleeves is utilized for the needle board drive, as the pushing rods 3 are driven independent of the axial motion of the guide sleeves 10 via the eccentric shafts 7. Yet it is recommended to match the sense of rotation of the eccentric shafts 12 and 13 with the pushing rod movement in such a way that there is an equidirectional lifting movement of the guide sleeves 10 and the pushing rods 3 at least over a certain range, thus leading to a low relative speed of the sliding movement between the pushing rods 3 and the guide sleeves 10. In FIG. 1 the two reversing positions of the additional drive 11 are outlined in full and dashed lines. To achieve a mass balance, a balancing shaft 20, rotating in opposite direction, is provided in the rest 15 beside the eccentric shafts 12 and 13.

Figure 2:
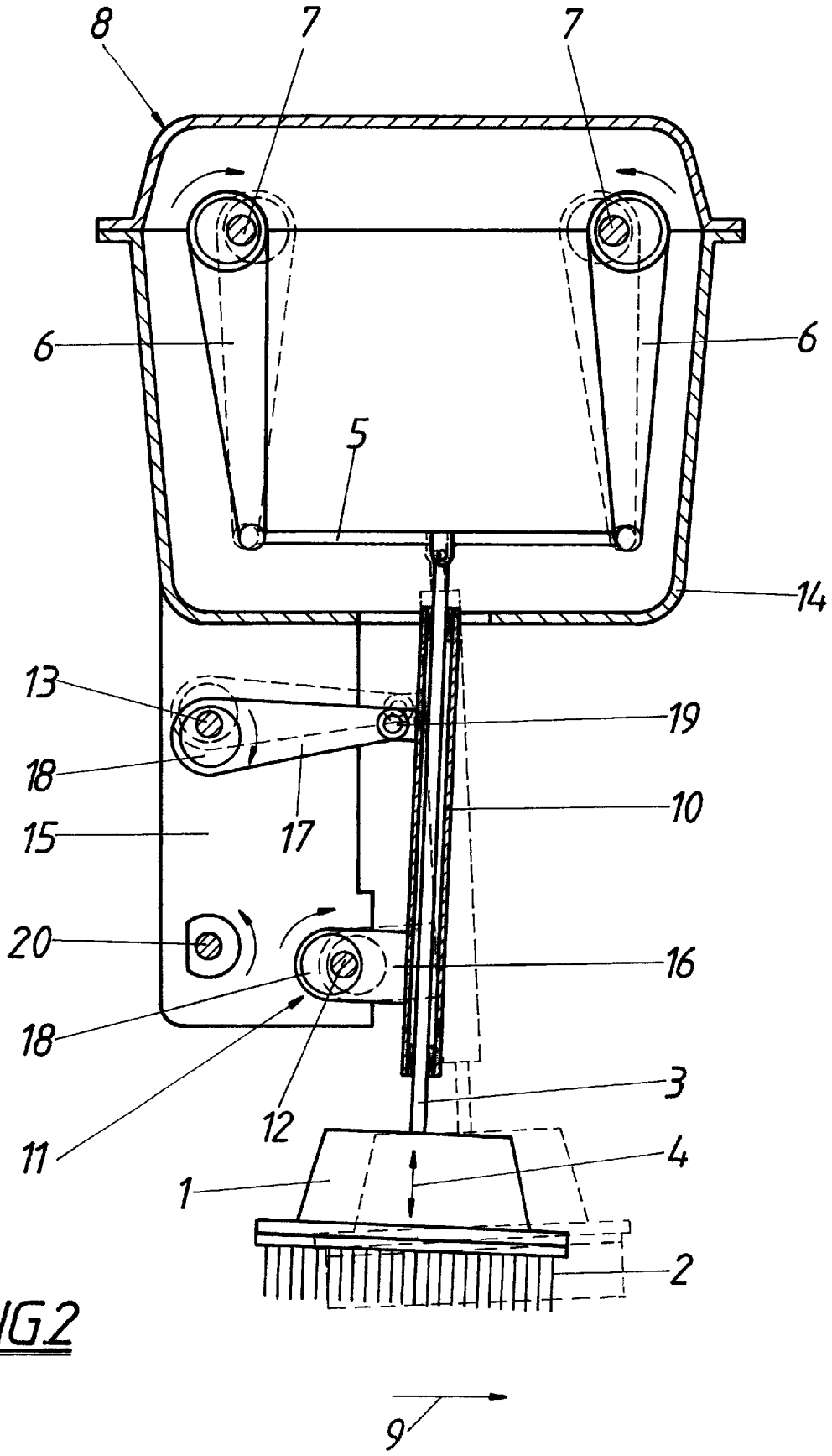
FIG. 2 represents a different embodiment of such an additional needle board drive analogous to FIG. 1.

According to FIG. 2 the two eccentric shafts 12 and 13 can be turned in their mutual phase position by means of a device not depicted in the drawing. To illustrate this circumstance, an offset angle of 90° was chosen in the example of embodiment, with the eccentric shaft 13 running behind by this angle against the eccentric shaft 12. This means that a rotary oscillation is superimposed to the reciprocating motion in fleece feed direction 9 of the guide sleeves 10, as this can again be inferred from the reversing positions of the additional drive 11 outlined in full and dashed lines. By means of this measure the amplitude of oscillation of the drive 11 in fleece feed direction 9 can be changed, so that this additional drive can be adapted to the required conditions with respect to the feed of fleece.

It need not be emphasized that the invention is not restricted to the depicted schematic examples of embodiment. Thus it is possible to interchange the arrangement of the rigid bracket 16 and the movable bracket 17, which has a corresponding effect on the conditions of motion to be provided for the needle board 2 in fleece feed direction 9.

What is claimed is:

1. An apparatus for needling a fleece fed to the apparatus in a feeding direction, which comprises (a) at least one needle board, (b) pushing rods for driving the needle board to an fro in a stitching direction, (1) each pushing rod being displaceably borne in a guide sleeve, and (c) an additional drive engaging each guide sleeve for reciprocating the guide sleeve in the feeding direction of the fleece, the additional drive comprising (1) two equidirectionally driven, parallel eccentric shafts, and (2) two brackets carrying the guide sleeve on the two eccentric shafts, the guide sleeve being nonrotatably connected to at least one of the brackets.

2. The needling apparatus of claim 1, wherein the guide sleeve is articulated to one of the brackets, and the additional drive further comprises a device for adjusting the mutual phase position of the two eccentric shafts.

* * * * *